US005697176A

United States Patent [19]

Kuni, Jr. et al.

[11] Patent Number: 5,697,176

[45] Date of Patent: Dec. 16, 1997

[54] GOLF CART DISPLAY PANEL

[76] Inventors: James Clifford Kuni, Jr., 6248 Miramonte Dr., Rockford, Mich. 49341; Edward Douglas Hughes, P.O. Box 386, Grayson, Ga. 30221

[21] Appl. No.: 344,972

[22] Filed: Nov. 25, 1994

Related U.S. Application Data

[63] Continuation-in-part of Ser. No. 27,753, Aug. 29, 1994, Pat. No. Des. 358,614.

[51] Int. Cl.[6] ..... G09F 21/04

[52] U.S. Cl. ..... 40/591; 40/607

[58] Field of Search ..... 40/591, 592, 308, 40/643, 618; 280/DIG. 5

[56] References Cited

U.S. PATENT DOCUMENTS

| | | | |
|---|---|---|---|
| D. 358,614 | 5/1995 | Hughes et al. | D20/18 |
| 1,566,167 | 12/1925 | Petersen et al. | 40/643 |
| 4,117,613 | 10/1978 | Hosker | 40/152.1 |
| 4,419,655 | 12/1983 | May . | |
| 4,480,310 | 10/1984 | Alvarez . | |
| 4,736,539 | 4/1988 | Dickinson | 40/591 |
| 4,988,025 | 1/1991 | Lipton et al. . | |
| 5,095,430 | 3/1992 | Bonito et al. . | |
| 5,190,340 | 3/1993 | Nuscher | 280/DIG. 5 |
| 5,214,679 | 5/1993 | Metcalf . | |

FOREIGN PATENT DOCUMENTS

| | | | |
|---|---|---|---|
| 96364 | 3/1924 | Austria | 40/607 |
| 583552 | 10/1958 | Italy | 40/607 |

*Primary Examiner*—Kenneth J. Dorner
*Assistant Examiner*—Cassandra Davis
*Attorney, Agent, or Firm*—Isaf, Vaughan & Kerr

[57] ABSTRACT

An improved golf cart display panel comprises an elongated plastic body forming a frame through which a color graphic representation of holes on a golf course can be viewed. The plastic body is sized to be mounted to the golf cart extending between the upstanding roof support posts on the front of the cart with the graphic display being presented to a golfer in the cart. The graphic display includes areas for advertising copy allowing sponsors to advertise their products and services to golfers riding in the cart.

10 Claims, 2 Drawing Sheets

GOLF CART DISPLAY PANEL

REFERENCE TO RELATED APPLICATION

This application is a continuation-in-part of U.S. patent application Ser. No. 29/027,753 filed Aug. 29, 1994, now U.S. Design Pat. No. 358,614 issued May 23, 1995.

BACKGROUND OF THE INVENTION

In the game of golf, it is very important for a player to know the layout of a fairway as well as the distance from the tee at various points on the fairway. The locations of sandtraps, water hazards, and other critical information is also important to a good consistent golf game. The player uses such information to judge which club he should use and to plan the general strategy of his golf shot.

In the past, various methods and devices for providing a golfer with critical information about a course have been available. Probably the most common has been the score card itself, which, in many instances, carries a small graphic representation of each hole on the course. While this has been used with some success for decades, it nevertheless exhibits certain inherent problems and shortcomings. Specifically, the graphic representations of the holes on score cards are necessarily small making it difficult to judge distances and angles. Score card displays of fairways and greens can also become outdated as holes are moved around on greens and the like. In addition, score card depiction of holes are troublesome to use because the cards must be manually folded or otherwise manipulated to reveal all the holes on the course.

Other devices for providing information to a golfer have also been proposed. Some of these devices are illustrated in U.S. Pat. Nos. 4,419,655 of May, 4,480,310 of Alvarez, 5,095,430 of Bonito et al., and 5,214,679 of Metcalf. The May patent shows an electronic device having a box with translucent front panel through which lights within the box can be seen. The lights are controlled to show the positions of the cup, the tee, and other attributes of the hole. While this device is somewhat useful, it is nevertheless highly complicated, unreliable, and not easily adaptable to changing conditions on the golf course.

The Alvarez patent shows a dead reckoning range finding device that measures the distance traveled by a golf cart to estimate distance to the hole. This device is complex and can be inaccurate depending on the path traveled by the cart. Further, it does not provide information about trap locations, fairway shapes, and the like. The Bonito et al. patent shows an electronic computer for installation in a golf cart. The computer has a screen and a memory that stores details of each hole. These details are then displayed as a graphic image on the screen. The problems with this device are, again, its inherent complexity as well as the small size and lack of screen resolution. In addition, the device of Bonito et al. would be very expensive to manufacture and maintain and requires a battery or other power source for its operation. The Metcalf patent shows another distance indicator that also functions by detecting the distance traveled by a golf cart. This device, like the others, is expensive, complicated, requires a power source, and is inherently unreliable.

Thus, there exists a continuing and heretofore unaddressed need for an improved method and apparatus for displaying to a golfer the details of the holes on the golf course. The device should be mountable on a standard golf cart in a position that does not interfere with the golfer and should display all of the holes on the course in a large detailed color format. The device should be rigid, weather proof, easily adapted to course changes, and should provide areas for strategic advertising displays. It is to the provision of such a method and apparatus that the present invention is primarily directed.

SUMMARY OF THE INVENTION

The present invention, in one preferred embodiment thereof, comprises a unique golf cart display panel that can be mounted on a golf cart in front of golfers riding on the cart. The panel comprises an elongated molded plastic body having a front section that forms a bezel or frame and a back that it telescopically received into the front section and mounted thereto with screws. A clear sheet of plexiglass is mounted in and framed by the bezel of the front section and a color silk screen display showing the layouts of the holes on the course is positioned within the body behind the sheet of plexiglass. Thus, the front section of the plastic body frames the graphic representation and the graphic representation is protected by the sheet of plexiglass, which is also framed within the bezel in the front section of the body.

The back of the plastic body is filled with a semi-rigid foam, which is trimmed to be flush with the rim of the back. The back is sized and shaped such that when it is telescopically inserted into the front section, the foam bares firmly against the graphic representation and against the plexiglass, holding both securely in place within the front section. Screws or other appropriate fasteners extend through the periphery of the front section and into the back and foam therein to hold the two sections of the display panel together.

The display panel of this invention is sized to be mounted on a golf cart extending between the two upstanding roof supports on the front portion of the cart. To this end, the body of the display panel is provided on each end with a mounting bracket that securely clamps onto a respective one of the upstanding roof supports to secure the panel on the cart. Preferably, the panel is mounted near the bottom ends of the supports so as not to obscure a golfers view when driving the cart. The front section of the panel body is angled to face golfers in the cart so that they are each provided with a clear view of the graphic representations of holes on the golf course simply by glancing at the panel. As an alternative to mounting the panel between upstanding roof supports, the panel could also be fixed on or molded into the fiberglass front cowl of the golf cart if desired.

It will thus be seen that a unique golf cart display panel is now provided that addresses and overcomes the problems of the prior art. Specifically, the panel displays in large bright easily readably graphics and to both golfers on a cart the layout and details of each hole on a golf course and presents the graphics to the golfers at a glance. The panel of this invention is easily adaptable to changing course conditions by simply removing the back of the body, inserting a new graphics panel, and reinstalling the back. The panel is simple and reliable, requires no external power source for operation, and is mounted on a golf cart in a location that is out of the way and does not interfere with a golfer's vision or movement in the cart. The graphic panel preferably is provided with locations that can be used by advertisers to advertise their products and services to golfers. These and other objects, features, and advantages inherent in this invention will become more apparent upon review of the detailed description set forth below when taken in conjunction with the accompanying drawings, a brief description of which follows.

DETAILED DESCRIPTION OF THE PREFERRED EMBODIMENT

Figure 1:
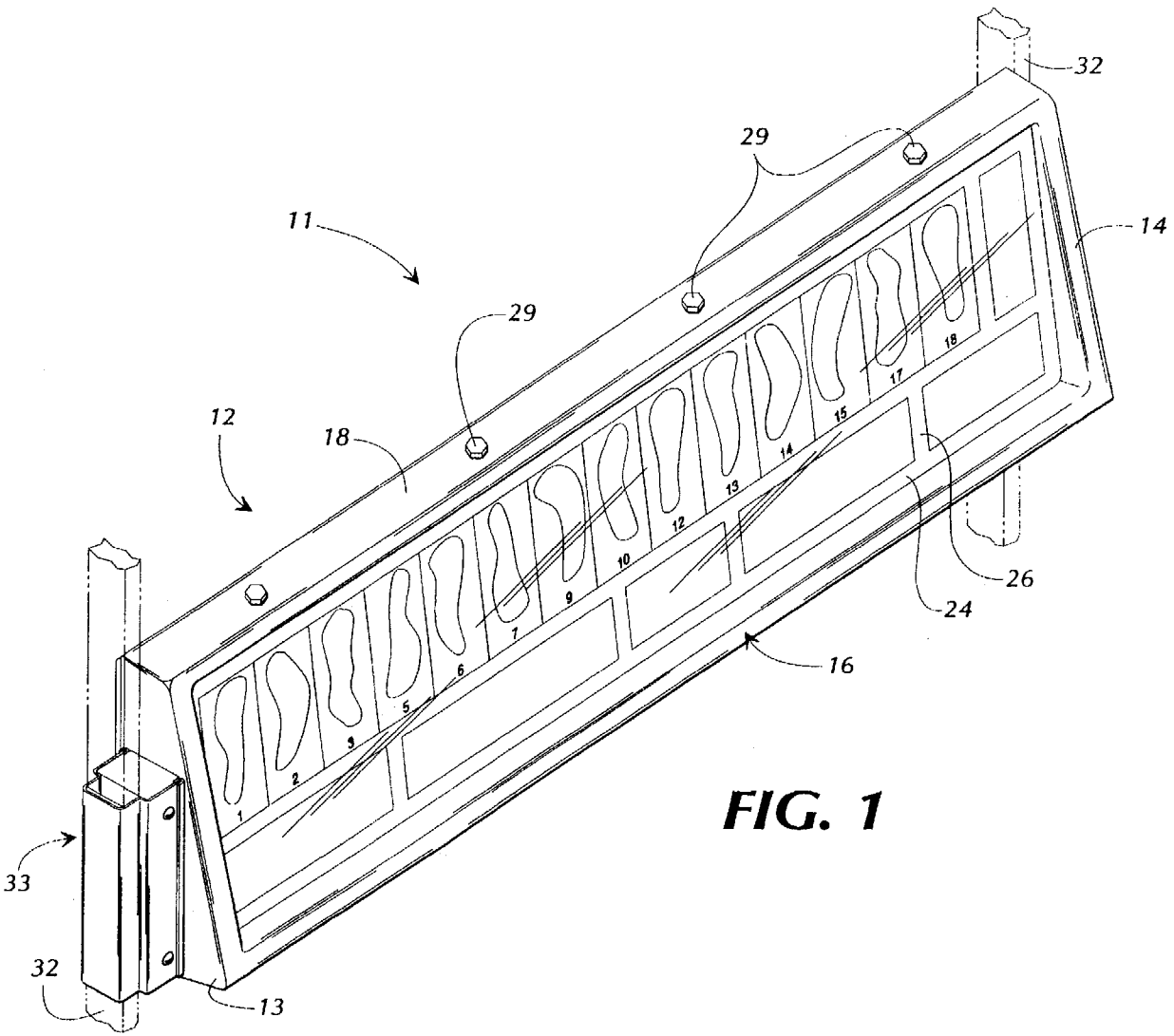
FIG. 1 is a perspective view illustrating a golf cart display panel that embodies principals of the present invention in one preferred form.
Figure 2:
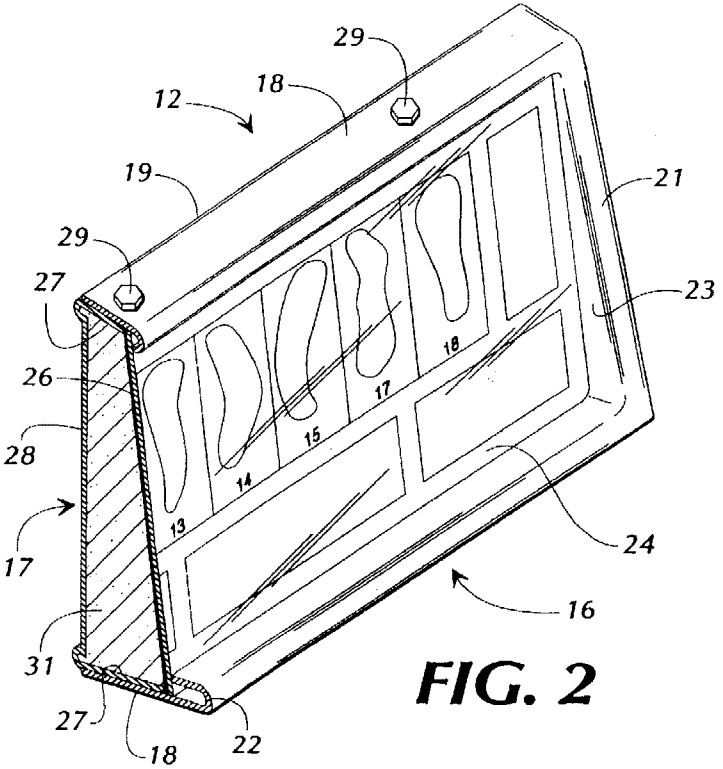
FIG. 2 is a perspective cut away view of the panel shown in FIG. 1 illustrating the fit of the foam filled back into the front section of the body.

Referring now in more detail to the drawings, in which like numerals refer to like parts throughout the several views, FIG. 1 illustrates in perspective format a golf cart display panel that embodies principals of the present invention in a preferred form. The display panel 11 comprises an elongated generally rectangular shaped body 12 having opposed ends 13 and 14. The body 12 preferably is formed of a vacuum or injection molded high impact plastic material. As best illustrated in FIG. 2, the body 12 is defined by a front section 16 and a back section 17. The front section 16 of the body 12 has peripheral sides 18 that define a rear edge 19 and forward edge 21 of the front section 16. The forward edge 21 is molded to form a bezel that frames the open face of the front section 16. More specifically, the forward edge 21 is molded to turn in on itself, thus defining a generally U-shaped cross section that forms the bezel as best illustrated at 22 in FIG. 2. Preferably, the bezel formed by the forward edge 21 is thicker at its bottom than at its top so that the bezel is tapered along the ends of the body as indicated at 23 in FIG. 2. Furthermore, the side 18 along the bottom of the body 12 is wider than the side 18 along the top of the body. In this way, the entire elongated body 12 is thicker at its bottom than at its top so that the front portion of the body is angled with respect to the back portion.

Mounted within the front section 16 resting against the back of the bezel is a clear protective plate 24 that preferably is formed of plexiglass or other rugged clear material. The clear plate 24 in conjunction with the bezel formed by the forward edge 21 forms a framed window through which an observer can peer. Mounted behind the clear protective plate 24 is a graphics panel that, in the preferred embodiment, bares graphic images of holes on a golf course and other informative material. Preferably, the graphics display panel is silk screen printed with high definition color representations of each hole on a golf course including distances from the tee, locations of yard markers, and other useful information. Also preferably included on the display panel 26 are areas for the printing of advertising logos and promotional messages. It is the intention that these areas can be purchased by local or national merchants to advertise their goods and services to golfers riding in the cart.

The back section 17 of the body 12 has peripheral sides 27 and a back panel 28. The peripheral sides 27 of the back section 17 define a forward edge of the back section and, like the front section, the sides 27 on the bottom are wider than the sides 27 on the top to form a tapered configuration of the back section 17. As shown in FIG. 2, the back section 17 is sized to be received telescopically into the front section 16 where the two sections are secured together by appropriate fasteners 29.

The back section 17 is filled with a light semi-rigid filler 31 that is trimmed flush with the peripheral front edge of the back section 17. The back section 17 is sized such that with the filler trimmed and the back section secured in place, the surface of the filler bares firmly against the graphic display panel 26 thus holding the display panel and the clear protective plate 24 securely in place against the bezel formed by the forward edge 16 of the front section 12. With this configuration, the filler also functions to reinforce the entire assembly forming a solid, strong, resilient structure that has proven resistant to all manner of abuse.

Figure 3:
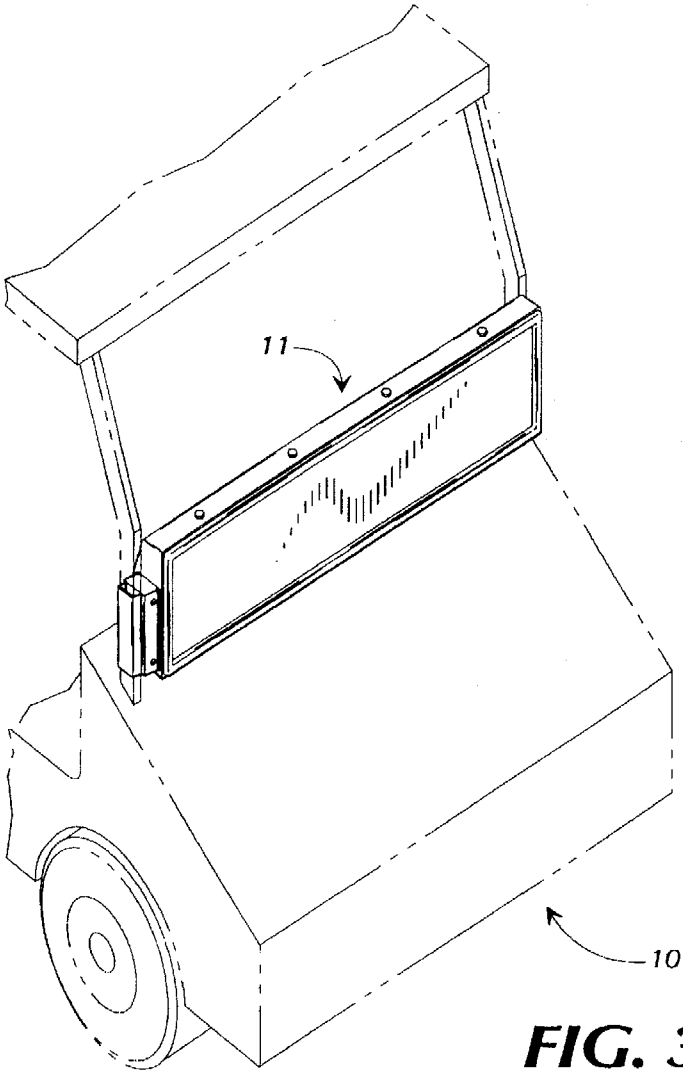
FIG. 3 is a perspective view showing the golf cart display panel of this invention mounted on a typical golf cart.
Figure 4:
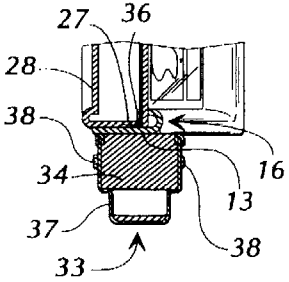
FIG. 4 illustrates a preferred embodiment of the mounting bracket provided on each end of the display panel for mounting the panel to the upstanding roof support rods of a golf cart.

Referring to FIGS. 1 and 3, the display panel of this invention is sized and configured to be mounted between the upstanding roof support posts 32 on the front portion of a standard golf cart. When the display panel is thus mounted, it is held in position just above the front cowl of the golf cart in clear view of golfers riding in the cart. To accommodate this mounting arrangement, the display panel 11 is provided on each of its ends 13 with a mounting bracket assembly 33. As best illustrated in FIG. 4, each of the mounting brackets 33 comprises a sizing block 34 that is secured to the panel end by means of screws or other appropriate fasteners. The sizing blocks 34 are provided to accommodate the slightly different distances between roof support posts on major brands of golf carts. For example, when the posts are closer together, the sizing blocks 34 are thinner whereas when the posts are farther apart, the sizing blocks are thicker. In use, the sizing blocks rest against the inside surfaces of the two upstanding roof support posts 32.

A generally channel shaped bracket 37 is secured to each of the sizing blocks 34 by means of screws 38 or other appropriate fasteners. The bracket 37 is sized to surround and tightly embrace an upstanding roof support post of the golf cart to secure the display panel 11 firmly in place between the two posts. Thus, the display panel 11 can be securely mounted between the upstanding roof support posts of any standard golf cart by means of the mounting bracket assemblies 33. An added advantage of mounting the display panel in this manner is that the panel tends to brace the roof support posts and the roof of the golf cart thus preventing the roof and its support posts from moving around and becoming loose during use.

FIG. 3 illustrates the forward portion of a standard golf cart showing the display panel of the present invention mounted between the upstanding roof support posts thereof. It can be seen from this figure that, with the display panel properly mounted, it rests out of the way of golfers in the cart, yet is clearly visible to the golfers. Thus, the panel does not obstruct the view of the golfers from the cart but nevertheless provides detailed graphic representations of each hole on the course to be played.

The present invention has been described herein in terms of preferred embodiments and methodologies. It will be obvious to those of skill in this art, however, that various additions, deletions, and modifications might well be made to the illustrated embodiment within the scope of the invention. For example, the display panel has been illustrated mounted to the bottom portions of the upstanding roof support posts. Clearly, the panel could also be mounted to the top portions of the posts adjacent the roof of a golf cart. In addition, the panel could be mounted directly to the front cowl of the golf cart if desired; however, such a mounting would require that mounting holes and the like be drilled in the cowl itself. Finally, the present invention could well be molded as an integral part of the front cowl itself such that it would become a permanent fixture of the golf cart. These and other additions, deletions, and modifications might well be made to the illustrated embodiments without departing from the spirit and scope of the invention as set forth in the claims.

We claim:

1. A golf cart display panel for displaying graphic representations of the holes of a golf course and other useful information to golfers riding in a golf cart having upstanding roof support posts on which said panel is installed, said golf cart display panel comprising:

an elongated body formed by a front section and a back section, said elongated body having opposed ends;

said front section of said elongated body having peripheral sides, a rear edge, and a forward edge with said forward edge forming a bezel that defines a window through which a golfer can peer;

said back section of said elongated body having peripheral sides defining a front rim and a back panel, said back section being sized and shaped to be received telescopically into said front section to form a closed-back configuration of said elongated body;

a graphic display board bearing information to be displayed to golfers, said graphic display board being located within said elongated body to be viewed through the window defined by said bezel;

means in said body for holding said graphic display board firmly in place against said bezel so that said graphic display board becomes framed in said window by said bezel; and means for mounting said elongated body to the upstanding roof support posts of a golf cart with said window and said graphic display board being presented to golfers riding in the golf cart;

said means for mounting comprising a sizing block secured to each of said opposed ends and a channel-shaped bracket secured to each of said sizing blocks, said channel-shaped brackets being sized to surround and embrace the upstanding roof support posts of a golf cart.

2. A golf cart display panel as claimed in claim 1 and wherein said elongated body is substantially rectangular in shape having opposed top and bottom sides joined by said opposed ends.

3. A golf cart display panel as claimed in claim 2 and wherein said elongated body is outwardly tapered in cross-section from its top side to its bottom side.

4. A golf cart display panel as claimed in claim 3 and wherein said bezel is configured as a lip that extends around said forward edge of said front section.

5. A golf cart display panel as claimed in claim 4 and wherein said lip is wider along said bottom side than along said top side.

6. A golf cart display panel as claimed in claim 1 and wherein said means for holding said graphic display board firmly in place against said bezel comprises filler means filling said back section and being trimmed to be substantially flush with the front rim of said back section whereby the filler means bears against the display board holding it in place against the bezel when said back section is received in and secured to the front section.

7. A golf cart display panel as claimed in claim 6 and wherein said filler means comprises semi-solid foam.

8. A golf cart display panel as claimed in claim 7 and further comprising a clear protective plate positioned in said window between said bezel and said graphic display board.

9. A golf cart display panel as claimed in claim 8 and wherein said clear protective plate comprises a rectangular sheet of plexiglass.

10. A golf cart display panel as claimed in claim 1 and further comprising a clear protective plate positioned in said window between said bezel and said graphic display board.

* * * * *